United States Patent [19]

Williams et al.

[11] Patent Number: 5,012,549

[45] Date of Patent: May 7, 1991

[54] SIDE LOADING DUAL PAIL WET VACUUM WITH FLOW DIVIDER

[76] Inventors: William H. Williams, 4938 Golden Arrow Dr., Rancho Palos Verdes, Calif. 90274; Paul G. Jacobs, 9958 Amestoy Ave., Northridge, Calif. 91325

[21] Appl. No.: 514,094

[22] Filed: Apr. 25, 1990

[51] Int. Cl.[5] ..... A47L 7/00

[52] U.S. Cl. ..... 15/320; 15/353

[58] Field of Search ..... 15/353, 320, 321

[56] References Cited

U.S. PATENT DOCUMENTS

| | | | |
|---|---|---|---|
| 3,921,250 | 11/1975 | Jerabek | 15/353 |
| 3,930,281 | 1/1976 | Principe et al. | 15/353 X |
| 4,062,085 | 12/1977 | Duncan | 15/353 X |
| 4,078,908 | 3/1978 | Blackman | 15/353 X |
| 4,216,563 | 8/1980 | Cuphert | 15/353 X |
| 4,233,706 | 11/1980 | Kauffeldt | 15/353 X |
| 4,467,494 | 8/1984 | Jones | 15/353 |
| 4,776,058 | 10/1988 | Garner et al. | 15/353 X |
| 4,864,680 | 9/1989 | Blase et al. | 15/353 X |

*Primary Examiner*—Chris K. Moore

*Attorney, Agent, or Firm*—Joseph E. Mueth

[57] ABSTRACT

In a liquid vacuum extraction system comprising a reservoir for fresh cleaning solution, means including a floor tool for applying said solution to the floor, carpet or other surface to be cleaned, vacuum means for sucking up the solution and contained dirt in an air stream from the surface being cleaned; the improvement comprising: a pair of spaced apart liquid reservoirs, each having an upper open end, a common closure sealing said upper open ends, said closure including an inlet communicating with said floor tool for return air bearing cleaning water and included dirt, and an outlet communicating with said vacuum means, said inlet communicating with a flow splitter head within the closure and positioned over said liquid reservoirs whereby all of the contained liquid is separated from the air and dropped into each of said liquid reservoirs at essentially equal rates while the air passes through to said outlet.

7 Claims, 2 Drawing Sheets

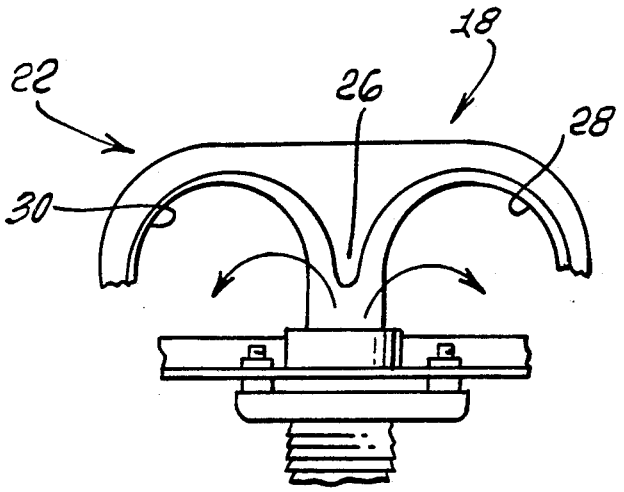
FIG. 2.
FIG. 3.
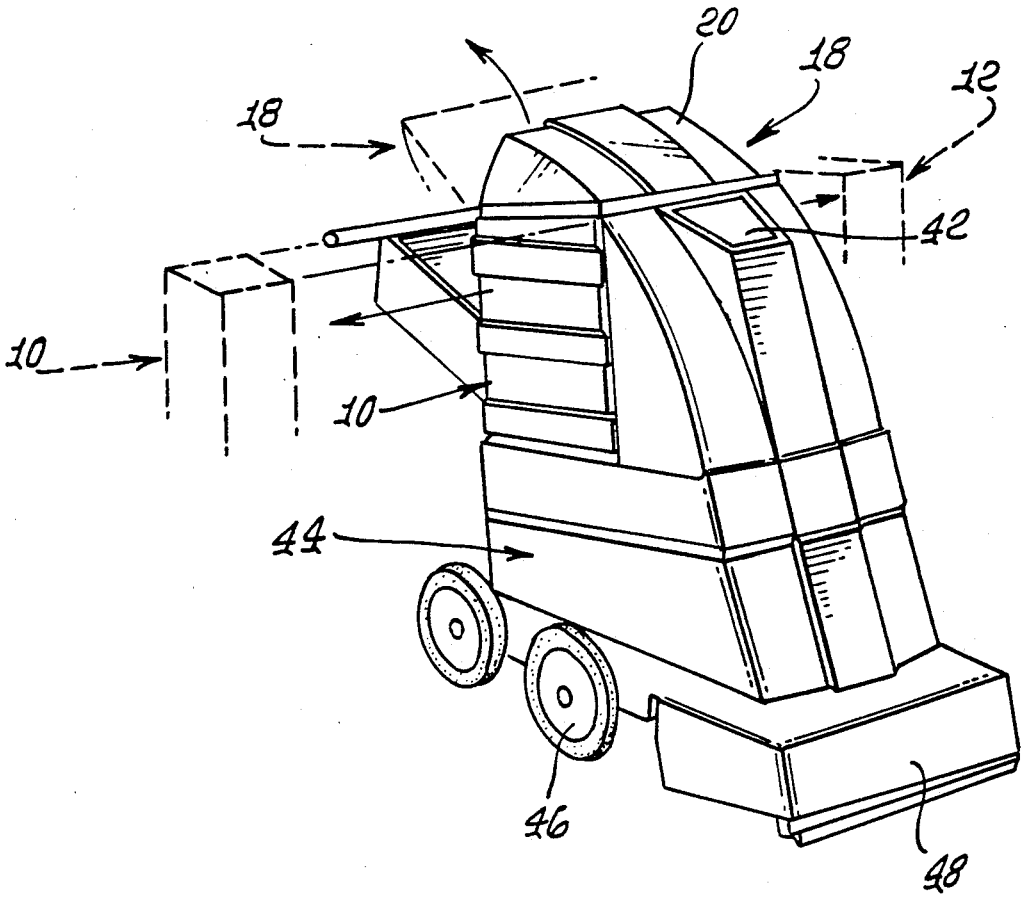

SIDE LOADING DUAL PAIL WET VACUUM WITH FLOW DIVIDER

BACKGROUND OF THE INVENTION

Wimsatt et al., U.S. Pat. No. 4,314,385, discloses a carpet cleaning system which, when operated in its liquid or wet mode, includes a single spent cleaning water collection tank of rectangular cross-section provided with a combination of baffles, one horizontal and the other vertical, to insure that only air drawn in by the vacuum motor can reach the top of a central vertical pipe projecting upwardly through the collection tank. In this way, spent cleaning water cannot reach and damage or short out the vacuum motor. In this system, all of the spent cleaning water is recovered and must be handled in a single container, making for heavy lifting by the user.

Noble, U.S. Pat. No. 3,056,994, discloses a vacuum cleaning apparatus which includes a single fresh cleaning water reservoir and a single receptacle for the dirty or spent cleaning water. This configuration also poses the problem of handling the weight of all of the water at one time.

Cyphert, U.S. Pat. No. 4,019,218, and Palmer et al., U.S. Pat. No. 4,759,094, pertain to carpet soil extractors having a fresh cleaning solution tank and a waste or spent cleaning solution tank. These extractors also has the deficiencies noted above.

In Karpanty, U.S. Pat. No. 4,464,810, there is described a scrubbing machine in which cleaning solution, usually mostly water, is cleaned and recirculated. The machine includes a frame supported on wheels with at least one scrubbing brush supported by the frame. A squeegee and vacuum hose are located behind the scrubbing brush for removing water from the surface which was supplied to the surface near the scrubbing brush. A recovery tank and a supply tank are supported on the frame with the vacuum hose communicating with the recovery tank. An exhaust blower also communicates with the recovery tank and draws air and water through the exhaust hose and into the recovery tank, exhausting air therefrom. The recovery tank is divided by internal baffles which form a tortuous path to separate the air and dirty water as they travel through the recovery tank in the path from one end to the other. Most of the water and dirt are received in the first chamber in which the dirt settles to the bottom, and cleaner water flows over an upper edge of a separating wall into the second chamber. The water in the second chamber can then be pumped to a dirt separator located in the first chamber and from there back to the supply tank from which water and a detergent, if used, are supplied to the vicinity of the scrubbing brush. This device also presents a single spent cleaning water reservoir which requires the physical handling of all of the water in one unit.

Hughes, U.S. Pat. No. 4,608,062, relates to an apparatus for the recovery of contaminated air and water from a flow system in some type of vacuum apparatus. The system provides a compartmentized stacked design embodying filters that first effect a moisture separation or demisting as the wet air passes downwardly through the system and then air borne particle filtering during the upward return of the airflow, with such functions being separated by a fluid collection tank at the bottom. The apparatus provides structure for removal of the filters and collected fluid so as not to interrupt the recovery process. There is no provision for separate reservoirs or for separation of airborne water into separate reservoirs.

The present invention, in general, is a significant advance in the art in that the water and dirt contained in an airstream is uniformly divided and the water and contained dirt are deposited equally into two receptacles or reservoirs which can be subsequently removed and the liquid disposed of with a minimum of effort. The invention is of particular importance in hospitals where large floor areas are scrubbed daily. The present invention provides for the disposal of the spent wash water in easily manageable quantities.

SUMMARY OF THE INVENTION

Briefly, the present invention relates to the following:

In a liquid vacuum extraction system comprising a reservoir for fresh cleaning solution, means including a floor tool for applying said solution to the floor, carpet or other surface to be cleaned, vacuum means for sucking up the solution and contained dirt in an air stream from the surface being cleaned; the improvement comprising:

a pair of spaced apart liquid reservoirs each having an upper open end, a common closure sealing said upper open ends, said closure including an inlet communicating with said floor tool for return air bearing cleaning water and included dirt, and an outlet communicating with said vacuum means, said inlet communicating with a flow splitter head within the closure and positioned over said liquid reservoirs whereby all of the contained liquid is separated from the air and dropped into each of said liquid reservoirs at essentially equal rates while the air passes through to said outlet.

It is an object of this invention to provide a novel wet vacuum system.

More particularly, it is an object of this invention to provide a novel wet extraction system wherein the used or spent liquid is continuously collected in two reservoirs by means of a flow splitter.

Still more particularly, this invention affords a means whereby the used cleaning liquid is collected in two containers which are separately removable from the chassis or transport framework of the vacuum cleaner for each disposal by virtue of the division of weight and the attendant reduction of effort and required physical strength.

These and other objects and advantages of this invention will be apparent from the more detailed description which follows, particularly when taken with the accompanying drawings.

The drawings to which we now turn are illustrative of the invention.

In the drawings:

FIG. 2 is a sectional view of the splitter head taken from above.

FIG. 3 is a perspective of the complete liquid extraction system of our invention.

DESCRIPTION OF PREFERRED EMBODIMENTS

Figure 1:
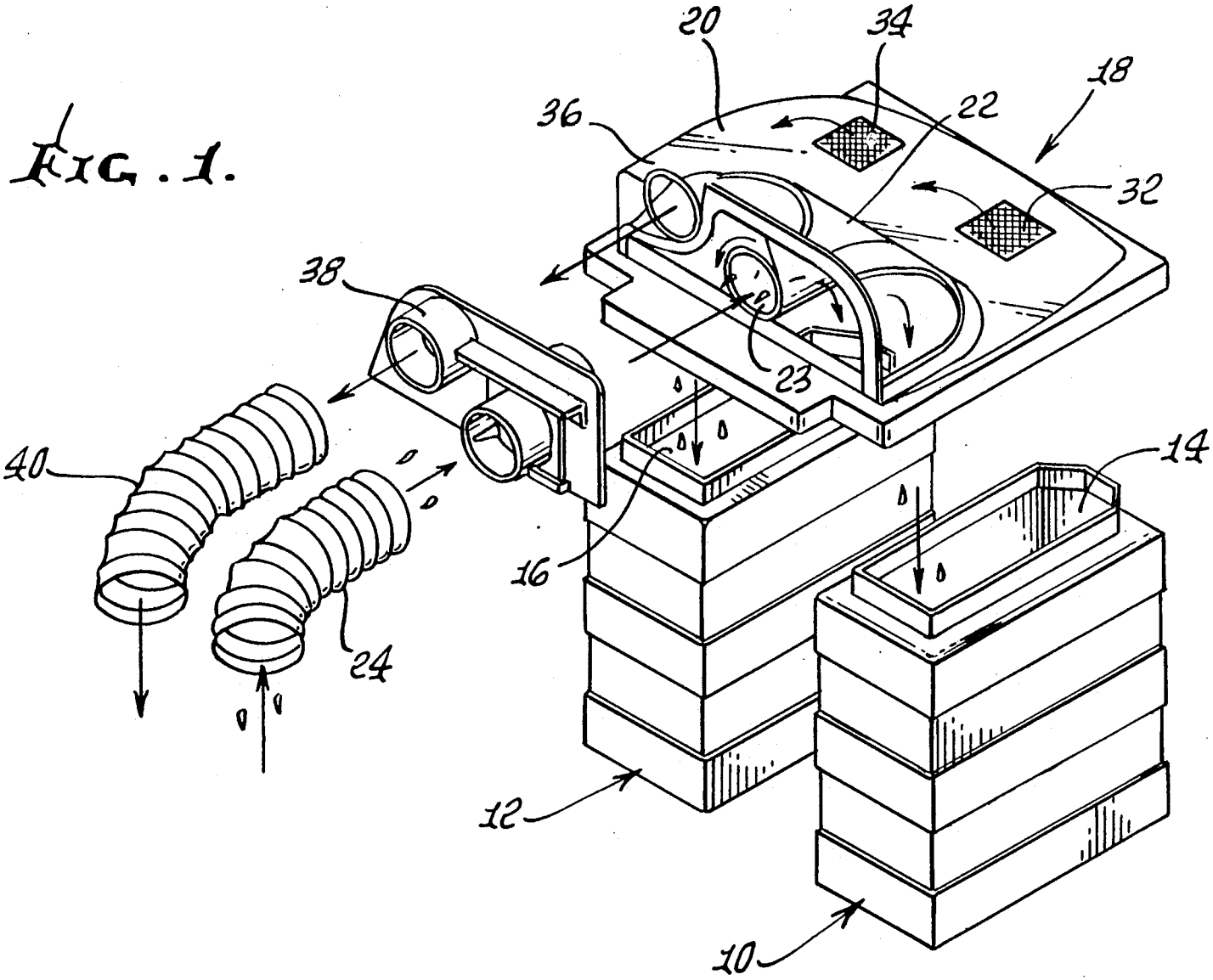
FIG. 1 is a perspective view, partially exploded, showing the splitter head and the pair of reservoirs.

Considering the drawings in more detail, the pair of matched spaced apart reservoirs 10 and 12 for receiving used or spent cleaning water each have open top ends 14 and 16, respectively. The under side of closure 18 forms an air tight seal with top ends 14 and 16. The top side of closure 18 has an overlying "bubble" member 20 which has two portions. One portion is the flow divider section 22 which communicates with the inlet 22 which, in turn, communicates with the hose 24 leading to a conventional floor tool. The air containing dirt and water flows upwardly in hose 24. The flow divider 22 has a central portion 26 and communicates with openings 28 and 30 passing through closure 18 and permits water and dirt to run, drip or flow into reservoirs 10 and 12. The air passing through openings 28 and 30 then passes under closure 18 and back up through screened openings 32 and 24 which leads to the second portion 36 of the bubble 20. The second portion 36 leads to outlet 38 which communicates with a conventional vacuum source via hose 40.

The system also has a separate reservoir 42 for clean or unspent solution. The system of the present invention is of the single pass type in which cleaning water is dispensed onto the surface to be cleaned, used once, and then sucked up and collected in reservoirs 10 and 12 for disposal. The reservoir is normally integral with the main body 44 of the liquid extraction system and the entire system is adapted to be wheeled about on wheels 46.

The vacuum motor and other normal wiring is carried within the body 44.

In operation, clean water is dispensed at the floor tool 48 in a conventional manner from the clean water reservoir. The water and associated dirt is drawn up hose 24 into flow divider 22 which has a hemispherical interior configuration on each side of portion 26 so that the flow is forced to make an 180° turn, producing a centrifugal action which causes the heavier materials, viz., water and dirt, to be thrown against the interior surfaces of the hemispheres and then fall or run down into reservoirs 10 and 12. The air is simply drawn through the closure 18, and back up through screened openings 32 and 34 and hence back to the vacuum motor.

Since reservoirs 10 and 12 are easily separated by lifting of closure 18, the user can lift reservoirs 10 and 12 separately, with handles (not shown), as illustrated by the dotted lines in FIG. 3. The spent water is thus divided in two so that only one half the water need be lifted and carried at any one time. This represents an important convenience to the user.

Having fully described the invention, it is intended that it be limited solely by the lawful scope of the appended claims.

I claim:

1. In a liquid vacuum extraction system comprising a reservoir for fresh cleaning solution, means including a floor tool for applying said solution to the floor, carpet or other surface to be cleaned, vacuum means for sucking up the solution and contained dirt in an air stream from the surface being cleaned; the improvement comprising:

a pair of spaced apart liquid reservoirs each having an upper open end, a common closure sealing said upper open ends, said closure including an inlet communicating with said floor tool for return air bearing cleaning water and included dirt, and an outlet communicating with said vacuum means, said inlet communicating with a flow splitter head within the closure and positioned over said liquid reservoirs whereby all of the contained liquid is separated from the air and dropped into each of said liquid reservoirs at essentially equal rates while the air passes through to said outlet.

2. The liquid vacuum extraction system of claim 1, wherein the cleaning solution is used once in the system and discarded.

3. The liquid vacuum extraction system of claim 1, wherein said closure includes a pair of screens through which the air passes to said outlet.

4. The liquid vacuum extraction system of claim 1, wherein each of said liquid reservoirs is manually portable and removable from said system.

5. The liquid vacuum extraction system of claim 1, wherein the entire system is manually portable.

6. The liquid vacuum extraction system of claim 1, wherein the entire system is carried on wheels.

7. The liquid vacuum extraction system of claim 1, wherein the system has a main fixed body which includes the reservoir for fresh cleaning solution integrally therewith.

* * * * *